US007959519B2

(12) United States Patent
Zielke et al.

(10) Patent No.: US 7,959,519 B2
(45) Date of Patent: Jun. 14, 2011

(54) GOLF CLUB HEAD WITH INSERT HAVING INDICIA THEREIN

(75) Inventors: Donovan Zielke, Hawthorn Woods, IL (US); Roger Twibell, Mission Hills, KS (US)

(73) Assignee: Clear Golf, LLC, Mission Hills, KS (US)

( * ) Notice: Subject to any disclaimer, the term of this patent is extended or adjusted under 35 U.S.C. 154(b) by 72 days.

(21) Appl. No.: 12/130,309

(22) Filed: May 30, 2008

(65) Prior Publication Data

US 2008/0312006 A1 Dec. 18, 2008

Related U.S. Application Data

(63) Continuation-in-part of application No. 11/281,058, filed on Nov. 16, 2005.

(51) Int. Cl.
*A63B 69/36* (2006.01)
*A63B 53/04* (2006.01)

(52) U.S. Cl. ..... 473/249; 473/250; 473/251; 473/340; 273/DIG. 14

(58) Field of Classification Search ..... 473/219–256, 473/324–350, 286; D21/736–746; 273/DIG. 14
See application file for complete search history.

(56) References Cited

U.S. PATENT DOCUMENTS

| | | | | |
|---|---|---|---|---|
| 1,454,267 | A * | 5/1923 | Challis et al. | 473/306 |
| 2,056,335 | A | 10/1936 | Wettlaufer | |
| 2,686,056 | A | 8/1954 | Oquist | |
| 2,880,002 | A | 3/1959 | Wetly | |
| 3,084,940 | A * | 4/1963 | Cissel | 473/332 |
| 3,134,596 | A * | 5/1964 | Boznos | 473/250 |
| 3,708,172 | A | 1/1973 | Rango | |
| 3,749,408 | A | 7/1973 | Mills | |
| 3,814,437 | A | 6/1974 | Winquist | |
| 3,815,910 | A | 6/1974 | Raines | |
| 3,841,640 | A | 10/1974 | Gaulocher | |
| 3,873,094 | A * | 3/1975 | Sebo et al. | 473/250 |
| 3,884,477 | A | 5/1975 | Bianco | |
| 4,324,404 | A * | 4/1982 | Dian | 473/340 |
| 4,369,974 | A | 1/1983 | Komperda | |
| 4,569,524 | A * | 2/1986 | Quijano | 473/342 |
| 4,573,685 | A | 3/1986 | Young, IV et al. | |
| 4,749,196 | A | 6/1988 | Podgor | |
| D334,039 | S | 3/1993 | Tanaka | |
| D349,319 | S | 8/1994 | Bayer | |
| 5,460,377 | A | 10/1995 | Schmidt et al. | |
| 5,467,989 | A | 11/1995 | Good et al. | |
| 5,605,510 | A | 2/1997 | Schmidt et al. | |
| 5,690,879 | A | 11/1997 | Lee | |

(Continued)

FOREIGN PATENT DOCUMENTS

JP 02268780 A2 11/1990

*Primary Examiner* — Sebastiano Passaniti
(74) *Attorney, Agent, or Firm* — Polsinelli Shughart PC

(57) ABSTRACT

A golf club head having an insert forming a window through the golf club head is described. The golf club head has upper and lower surfaces. The golf club head includes a body with a heel, a toe, a front portion with a striking face, and a back portion. The front portion of the body forms a striking face. The body includes an aperture extending from the upper surface to the lower surface and extending from the front portion to an inside portion of the back portion. An insert is secured within the aperture. An indicia within the insert is visible from the upper and lower surfaces of the golf club head.

18 Claims, 15 Drawing Sheets

U.S. PATENT DOCUMENTS

| | | | | |
|---|---|---|---|---|
| 5,749,791 | A | 5/1998 | Passeri, Jr. | |
| 5,842,935 | A | 12/1998 | Nelson | |
| 5,924,939 | A | 7/1999 | Grace et al. | |
| 5,972,144 | A | 10/1999 | Hsu | |
| 6,059,669 | A | 5/2000 | Pearce | |
| D437,017 | S | 1/2001 | Ford | |
| 6,200,229 | B1 | 3/2001 | Grace et al. | |
| 6,244,972 | B1 | 6/2001 | Drossos | |
| 6,435,975 | B2 * | 8/2002 | Middleton | 473/231 |
| 6,471,600 | B2 * | 10/2002 | Tang et al. | 473/242 |
| 6,478,694 | B2 | 11/2002 | Anderson et al. | |
| 6,524,196 | B1 | 2/2003 | Yeh | |
| D485,321 | S | 1/2004 | Breier et al. | |
| 6,729,972 | B2 | 5/2004 | Boord | |
| 6,743,114 | B2 | 6/2004 | Best | |
| 6,835,144 | B2 | 12/2004 | Best | |
| 6,951,518 | B2 | 10/2005 | Solheim et al. | |
| 6,960,140 | B2 * | 11/2005 | Solheim et al. | 473/251 |
| 6,986,716 | B2 | 1/2006 | Lukasiewicz, Jr. et al. | |
| 7,022,030 | B2 * | 4/2006 | Best et al. | 473/340 |
| D523,102 | S | 6/2006 | Stites et al. | |
| 7,083,525 | B2 * | 8/2006 | Pond et al. | 473/251 |
| 7,083,526 | B2 * | 8/2006 | Durnin | 473/251 |
| 7,086,957 | B2 | 8/2006 | Solheim et al. | |
| 7,112,147 | B2 | 9/2006 | Solheim et al. | |
| 7,115,041 | B2 | 10/2006 | Guard et al. | |
| 7,294,066 | B1 | 11/2007 | Richard, Jr. | |
| 7,309,291 | B1 | 12/2007 | Bryant et al. | |
| D564,607 | S | 3/2008 | Oldknow et al. | |
| 7,344,451 | B2 | 3/2008 | Tang et al. | |
| 7,351,162 | B2 | 4/2008 | Soracco et al. | |
| 7,601,073 | B2 * | 10/2009 | Henry | 473/249 |
| 2001/0055212 | A1 | 12/2001 | Phillips | |
| 2003/0017885 | A1 | 1/2003 | Heene et al. | |
| 2003/0032497 | A1 | 2/2003 | Sano | |
| 2003/0054899 | A1 | 3/2003 | Dupille | |
| 2003/0148821 | A1 | 8/2003 | Morgan et al. | |
| 2003/0203766 | A1 | 10/2003 | Sano et al. | |
| 2005/0043111 | A1 | 2/2005 | Albert et al. | |
| 2005/0181889 | A1 * | 8/2005 | Green | 473/340 |
| 2005/0233109 | A1 | 10/2005 | Hettinga | |
| 2007/0026963 | A1 * | 2/2007 | Braynt et al. | 473/340 |
| 2007/0049402 | A1 * | 3/2007 | Sanchez et al. | 473/340 |
| 2007/0111816 | A1 | 5/2007 | Zielke et al. | |
| 2009/0017934 | A1 * | 1/2009 | Stites et al. | 473/290 |

* cited by examiner

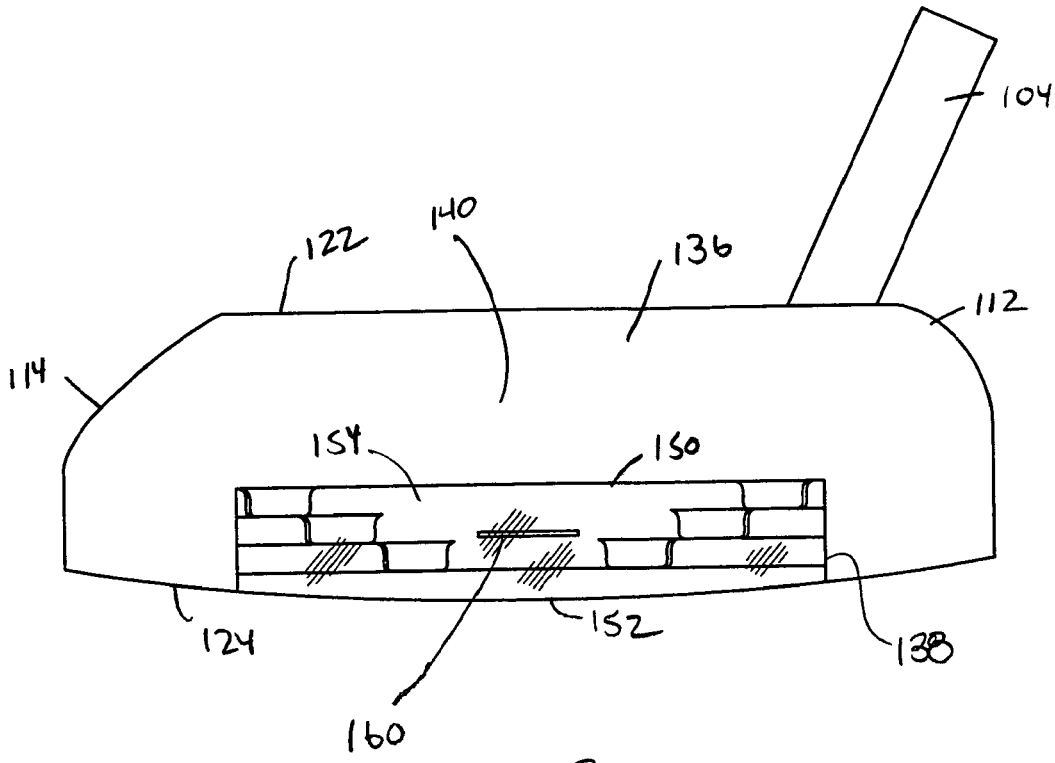
Fig 2
Fig 3
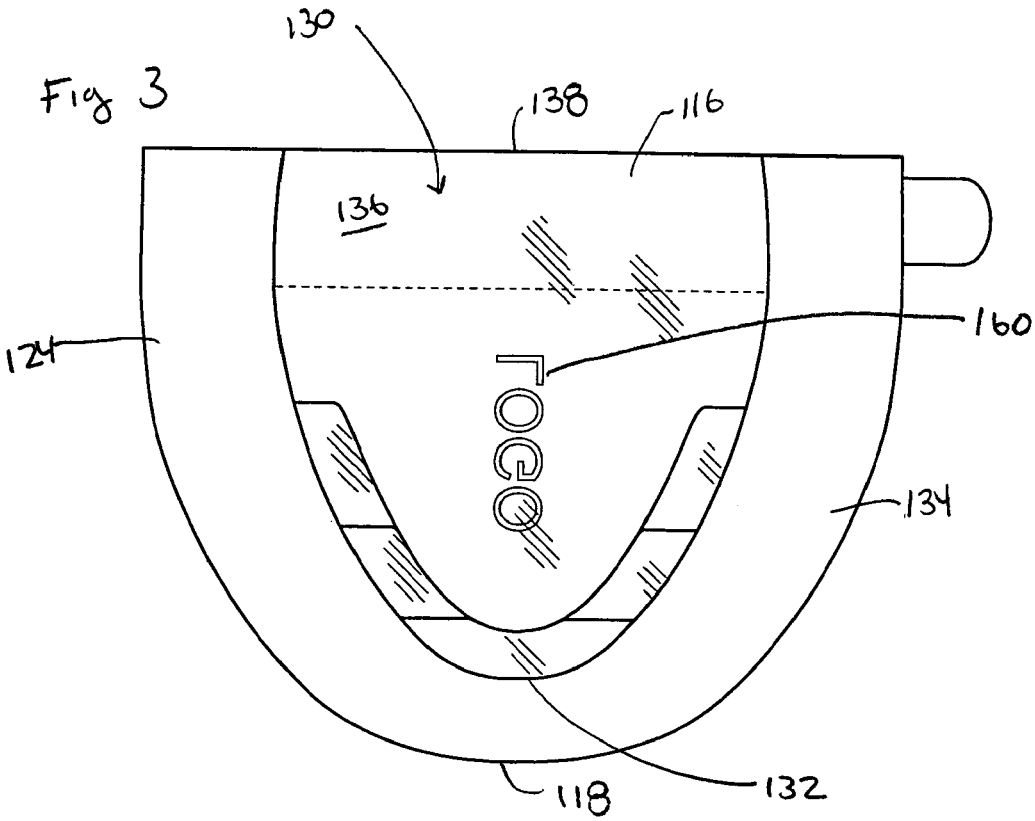

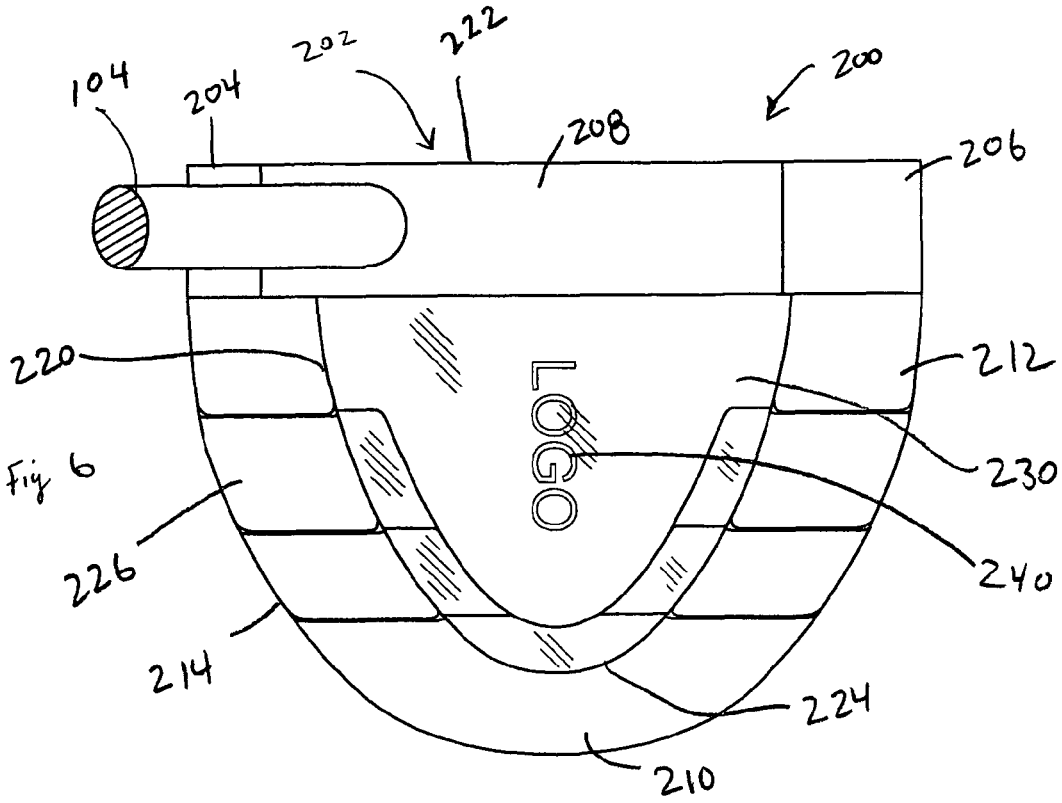
Fig 6
Fig 7
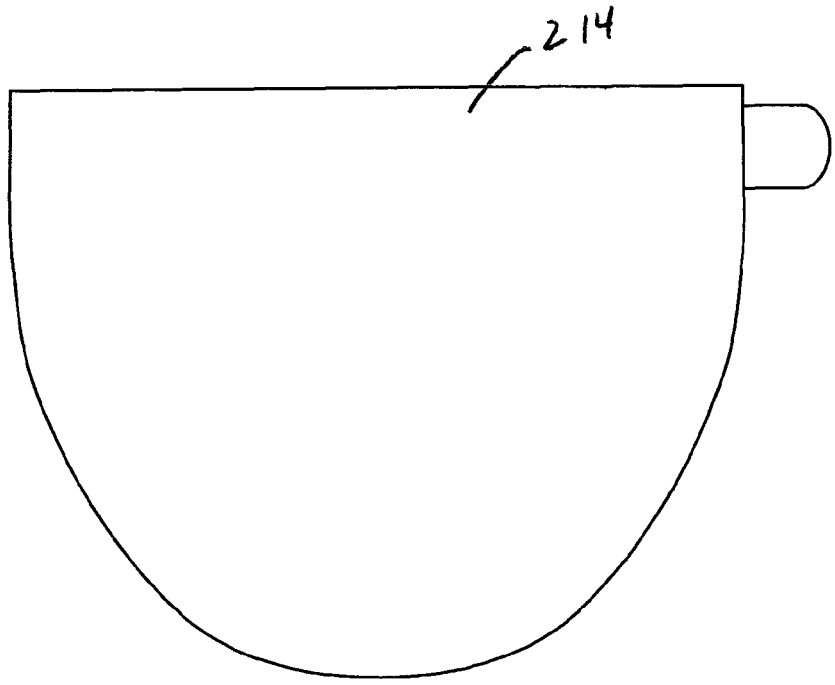

GOLF CLUB HEAD WITH INSERT HAVING INDICIA THEREIN

This application is a continuation-in-part of U.S. patent application Ser. No. 11/281,058 filed Nov. 16, 2005.

FIELD OF THE INVENTION

The present invention relates to a golf club head, more specifically, the present invention relates to a golf club head with a transparent insert that has indicia therein.

BACKGROUND OF THE INVENTION

Various kinds of putter heads with inserts are known in the prior art. For example, U.S. Patent Publication 2005/0043111 to Albert et al. relates to the placement of a polymer insert in a recess. The recess can be formed in the striking plate of a putter head or the crown of a wood head. Within the recess is a pattern or logo.

In another example, U.S. Patent Publication 2003/0017885 discloses the use of a polymer insert, which has indicia printed on the surface of the insert, that is disposed in a recess of the club face. The indicia is only visible through the club face.

In another example, U.S. Pat. No. 6,729,972 is directed to having an putter head with a three layer insert placed in a recess in the club face. The three layer insert includes a middle indicia layer. The indicia is thus only visible from the front of the club face.

Other examples include U.S. Pat. Nos. 5,605,510 and 5,460,377 which are directed to having an putter head with a recess and a monogrammed insert. The indicia is visible rearwardly or through the front face depending upon the direction of the monogram. U.S. Pat. Nos. 6,200,229 and 5,924,939 disclose having two layers of differently colored material. The first layer is molded with projections, and the other with corresponding recesses which the projections fit into. The projections have visible through the front strike face of the insert.

In addition, U.S. Pat. No. 5,972,144 is directed to manufacturing a golf club head that includes adhering a decorative plate on a recess in the striking face and pouring a resin over the face to secure the place therein. The indicia is thus only visible from the front of the club face.

Although various golf club heads with inserts and indicia have been disclosed, the prior art does not provide for the advantages and objectives of the present invention.

SUMMARY OF THE INVENTION

In accordance with one embodiment of the present invention a golf club head is provided. The club head includes a heel, toe, front portion with a defined striking face, a back portion, an upper surface and a lower surface. An aperture is defined in the body as extending from the upper surface to the lower surface and extending from the front portion to an inside portion. The inside portion may be defined as a portion between the front portion and the back portion. An insert is further provided and is secured within the aperture. Lastly, an indicia is provided within the insert and is visible through the upper surface and lower surface of the golf club head. Furthermore, the aperture may extend from the striking face such that the insert of mating configuration to the aperture forms at least a portion of the striking face. Preferably, the insert is of a transparent or semi transparent material.

In another embodiment of the present invention, a golf club is provided with a heel, toe, front portion with a defined striking face, a back portion, an upper surface and a lower surface. A recess is provided in the body and is defined as extending downwardly from the upper surface and extending inwardly from the striking face. An insert is secured within the recess such that the insert forms a portion of the striking face. An indicia within the insert is provided that is visible through the upper surface.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein:

FIG. 2 is a front view of the club head from FIG. 1;

FIG. 3 is a bottom view of the club head FIG. 1;

FIG. 6 is a top view of a second club head in accordance with the present invention;

FIG. 7 is a bottom view of FIG. 6;

DETAILED DESCRIPTION OF THE EMBODIMENTS

Figure 1:
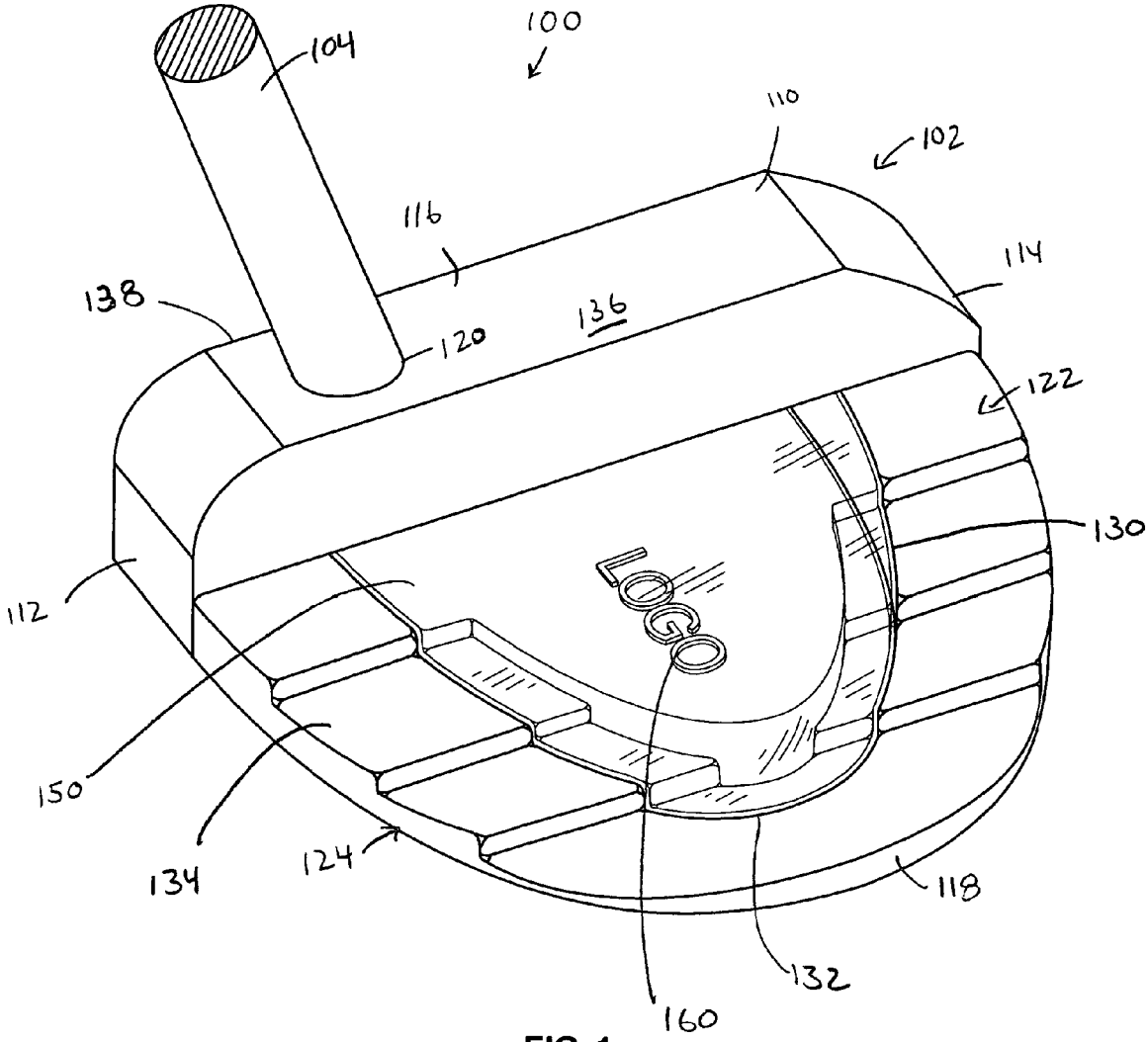
FIG. 1 is a rear perspective view of the club head in accordance with the present invention.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Referring now to FIGS. 1-5, there is shown a first illustrative embodiment golf club head in accordance with the present invention, designated generally at 100, as part of a golf club 102, with only part of the shaft 104 being visible.

The golf club head 100 is shown as a putter, however, the golf club may take any form of club. The club head 100 comprises a body 110 having a heel 112, toe 114, a front portion 116 and a back portion 118. The shaft 104 is secured to a hosel 120 in the front portion of the club head 100 or may be secured directly into the club head 100. The body 110 further includes an upper surface 122 and a bottom surface 124. The body 110 also includes an aperture 130 formed from the front portion 116 to an inside portion 132. In the first embodiment, the aperture 130 extends from the front striking face 138 to the inside portion 132. The front striking face 138 is a region defined on the front face 140 of the club that is used to strike a ball (not shown). The inside portion 132 is defined as a point between the front portion 116 and the back portion 118 but may very well extend all the way to the back portion 118. As illustrated, a backside arc portion 134 extends from heel 112 to toe 114 and from front portion 116 to back portion 118 to create the aperture 130 therebetween. In addition, as illustrated, a U-shaped bridge 136 is formed on the front face 140 from heel 112 to toe 114 over the aperture 130.

In the first embodiment, the aperture 130 provides the ability to have a transparent, semi-transparent, see-through or visible window through the club head from the upper surface 122 to the lower surface 124. The aperture 130 is filled with a material to create an insert 150 that further facilities the visible window. The insert 150, in accordance to the first embodiment includes a lower surface 152 that extends the lower surface 124 of the body from heel 112 to toe 114, and includes an upper surface 156. As shown, the lower surfaces 152 and 124 may be curved, however, it is contemplated that the lower surfaces be straight or planar. The insert 150 further includes a striking region 154 at the striking face 138. As such, the insert 150 not only provides a visible window from the upper surface 122 to the lower surface 124 but also provides a striking face 138.

Embedded in the insert 150 is indicia 160. The indicia may be any logo, word, letter, number, design, or combination thereof. In accordance to the first embodiment, the indicia 160 is visible from the upper surface 122 when the club 100 is in use and visible from the lower surface 124 when the club is turned upside down and resting in a golf bag. While the indicia 160 is shown in reverse on the lower surface 124 the present invention contemplates having the indicia 160 on both sides of a non see-through plate, such that the indicia 160 can be read and/or properly viewed when the club 100 is in use or turned upside down. In addition, the indicia may be different on both sides such that different logos or information may be viewed from the top then from the bottom.

Preferably, the body is formed as an integral piece of material. However, it can be constructed in pieces and assembled. In the preferred embodiment, the body is made from one or more of the following material, bismuth metal, bismuth oxide, bismuth trioxide, barium sulfate, calcium carbonate, alumina, mica, iron, iron oxide, zirconium, zirconate, ceramic, carbon, glass spheres, plastic spheres, ceramic spheres, copper, zinc, zinc oxide, stainless steel, tungsten, lead or titanium. The material may further be reinforced with one or more of the following materials: fiber glass, carbon fiber, ceramic fibers, aramid (Kevlar), polyester fiber, nylon, cotton, wool, or acrylic. The reinforced material can be strands, mesh or woven.

Preferably the insert is formed as an integral piece of material. In the preferred embodiment, the insert is made from a thermoset plastic, such as a thermoplastic transparent polymer, urethane, polyurethane, aliphatic, or aromatic. Other materials that may be used include epoxy, polyester, vinyl ester, phenolics, styrenes, or thermoset rubber.

Figure 4:
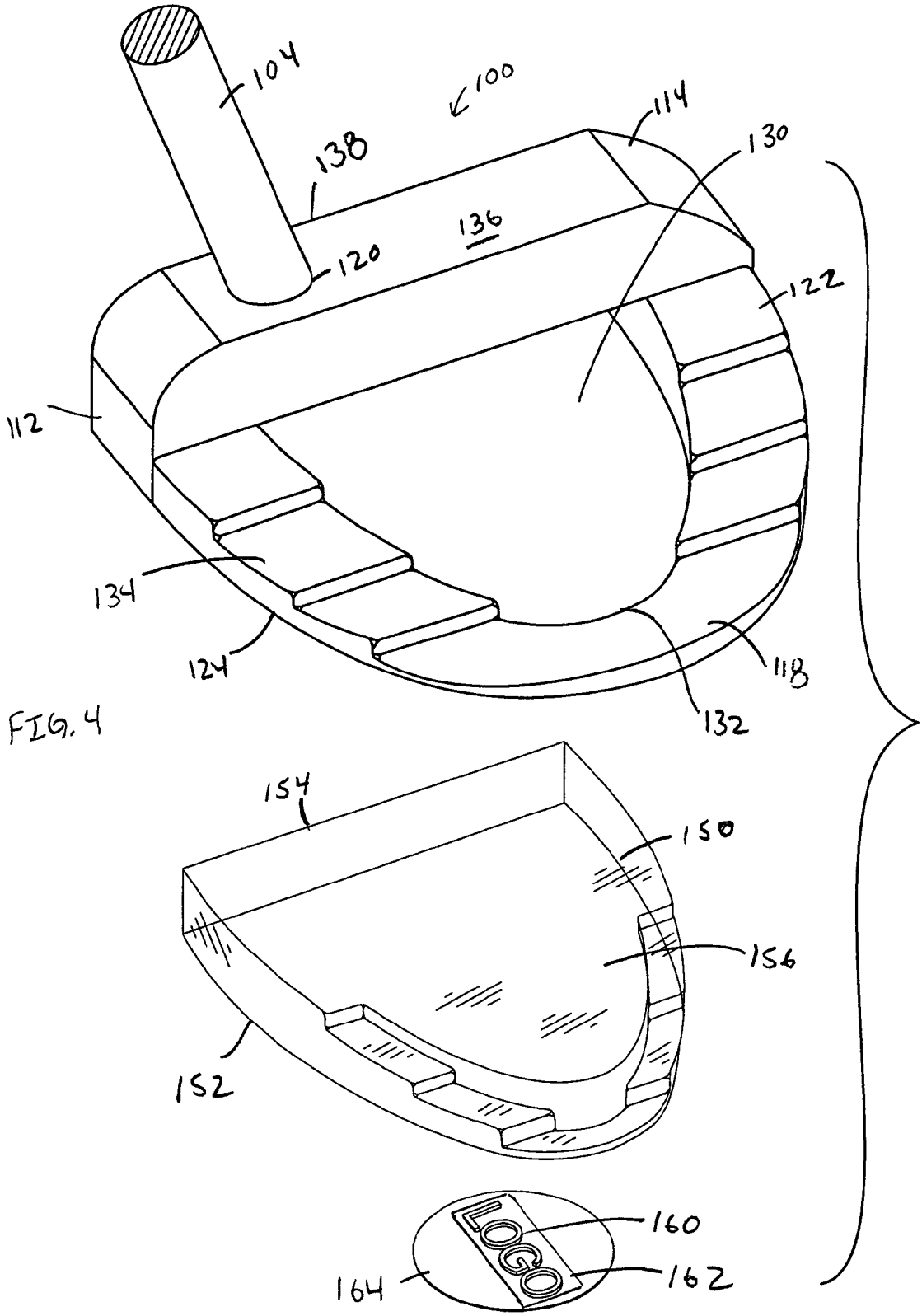
FIG. 4 is an exploded view of the assembled club head from FIG. 1.
Figure 5:
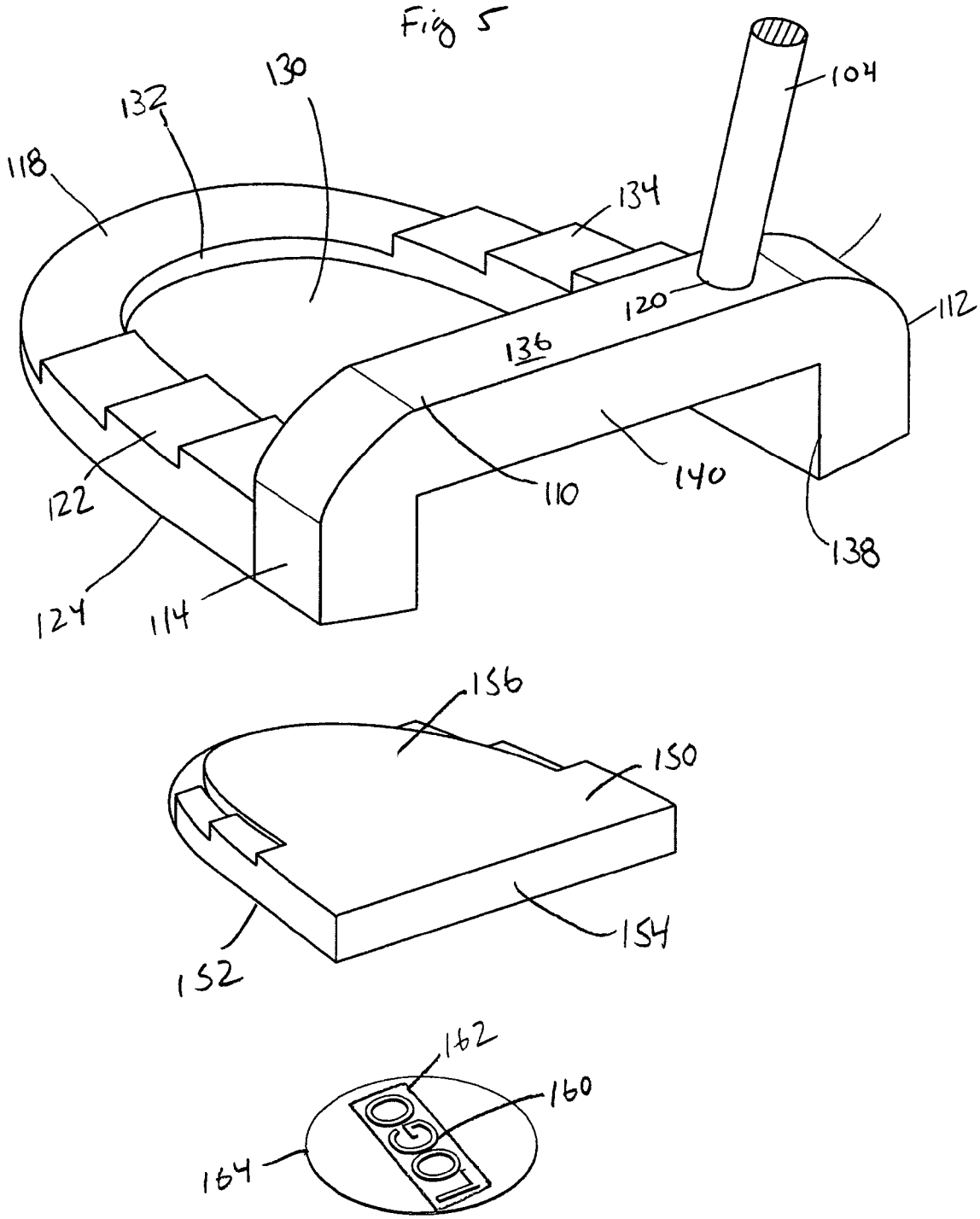
FIG. 5 is a rear perspective exploded view of FIG. 1.

Referring now to FIGS. 4 and 5, in the manufacturing process of the first embodiment of the present invention, the indicia 160 may be placed on a board 162. The board 162 may be transparent, semi transparent or opaque. The indicia 160 (with or without the board 162) is mounted onto a Mylar film or other transparent material 164. The transparent material 164 is held in a mold while the insert material is cast there around it to form said insert 154 with the indicia 160 position therein. After the insert 154 has set or is finished, the insert 154 is held in a mold while the body material is cast there around and allowed to set. When placed on an opaque board, an identical or second indicia would be placed on the underside of the board as well as being placed on the upperside of board. This would provide for indicia that is properly read or seen from both the upper surface and the lower surface of the club head.

Figure 8:
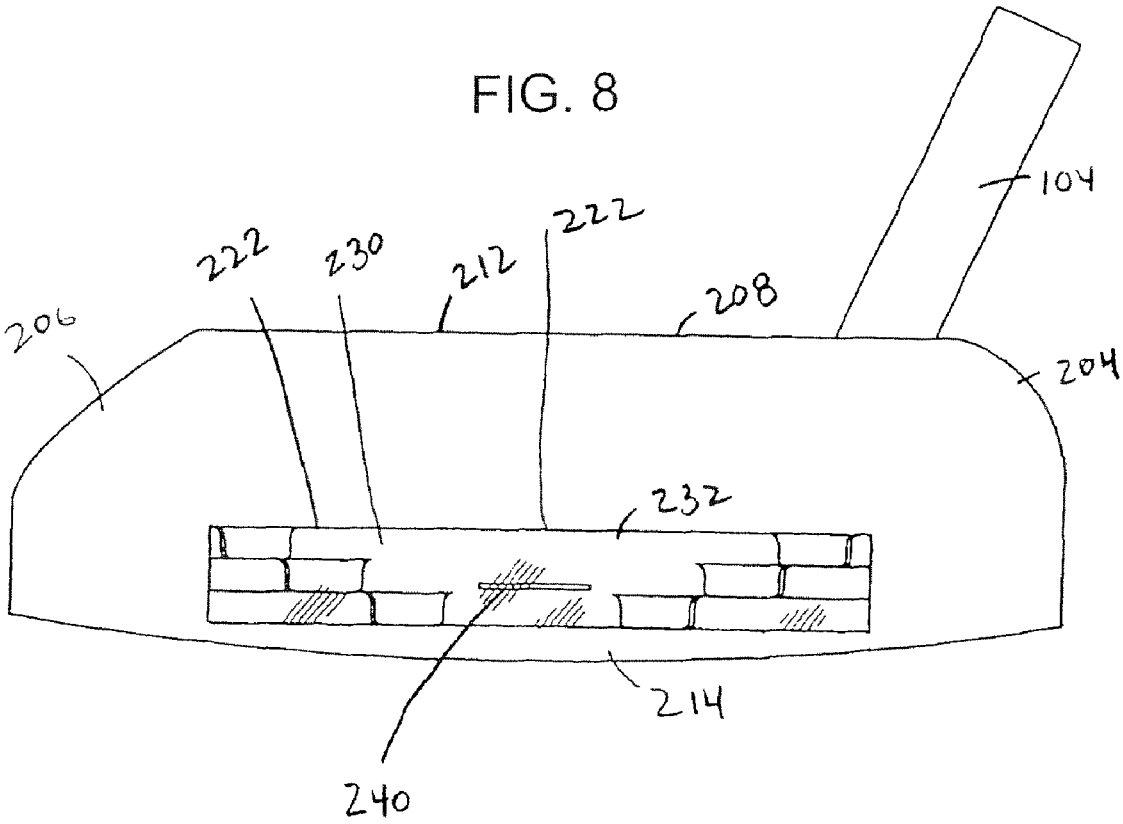
FIG. 8 is a front view of FIG. 6.

In a second embodiment of the present invention, FIGS. 6-8, the golf club head 200 includes a body 202 defined with a heel 204, toe 206, a front portion 208 and a back portion 210. The body 202 of the golf club head further includes an upper surface 212 and a bottom surface 214. The body 210 also includes a recess 220 formed from a front striking face 222 to an inside portion 224. (The inside portion 224 defined as a point between the front striking face 222 and the back portion 210 but may very well extend all the way to the back portion 210.) The recess 220 further extends downwardly from the upper surface 212 towards the bottom surface 214. However, the bottom surface 214 is still maintained as part of the body 202.

The recess 220 has secured therein an insert 230. The insert 230 forms a portion 232 of the front striking face 222. Within the insert 230 is indicia 240 that is visible through the upper surface 212 of the club head 200.

Figure 9:
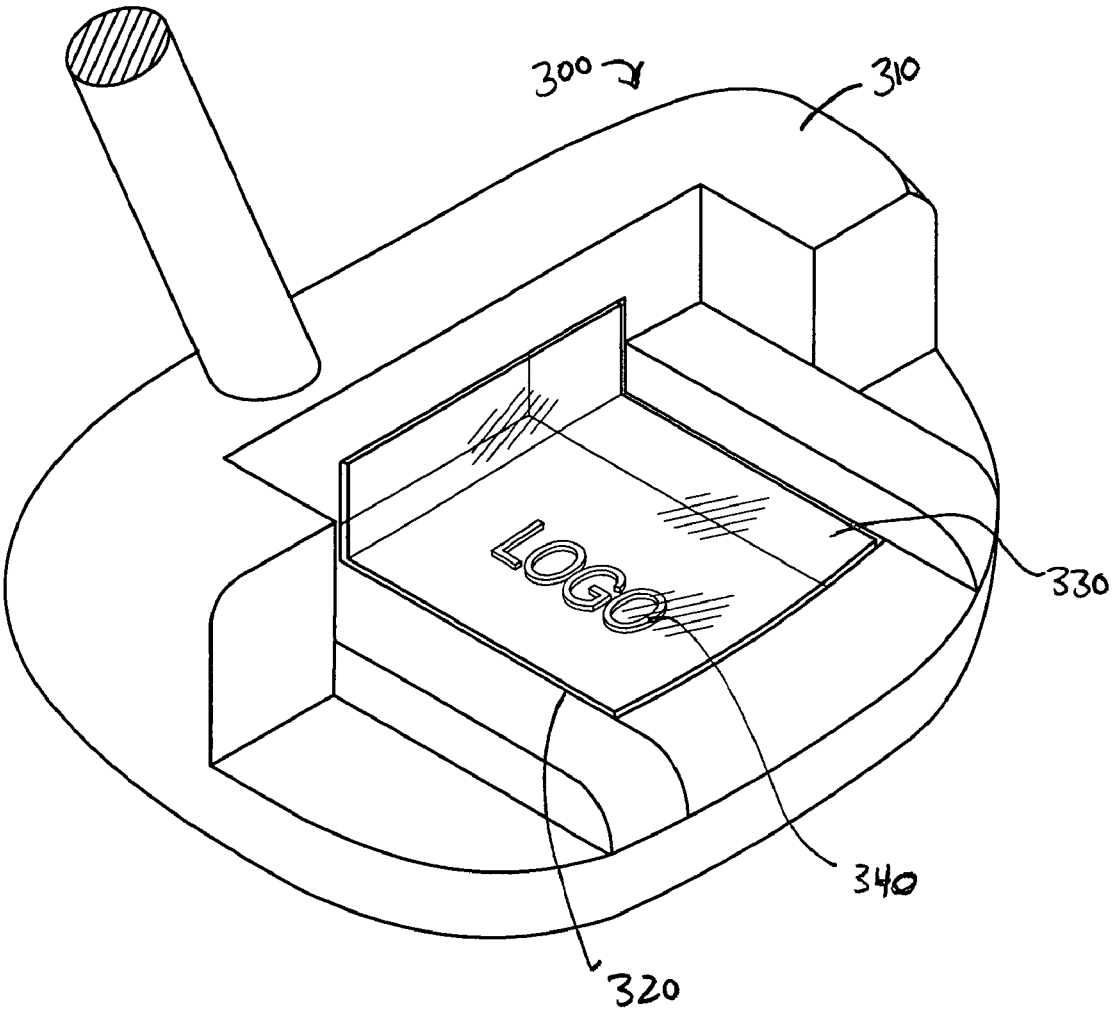
FIG. 9 is a rear perspective view of an alternative club head in accordance with the present invention.

In a third embodiment of the present invention, FIG. 9, the golf club head 300 includes a body 310 shaped differently then the previous embodiments. The third embodiment still includes an aperture or recess 320 with an insert 330 that has indicia 340 that is visible through the upper surface of the body. It is simply included to show that alternative club head designs may be used without deviating from the scope and spirit of the invention.

Figure 10:
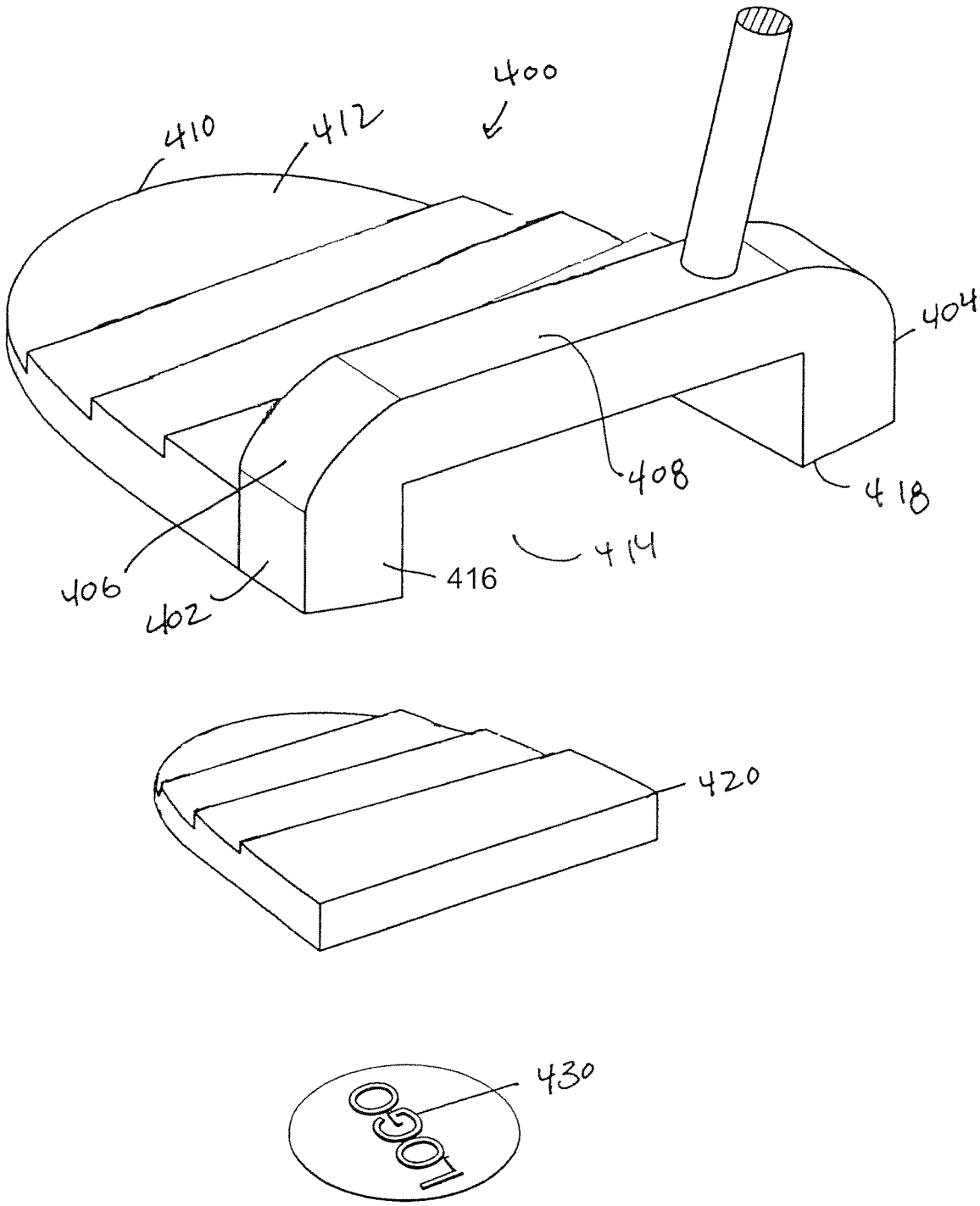
FIG. 10 is a rear exploded view of a fourth alternative club head in accordance with the present invention.
Figure 11:
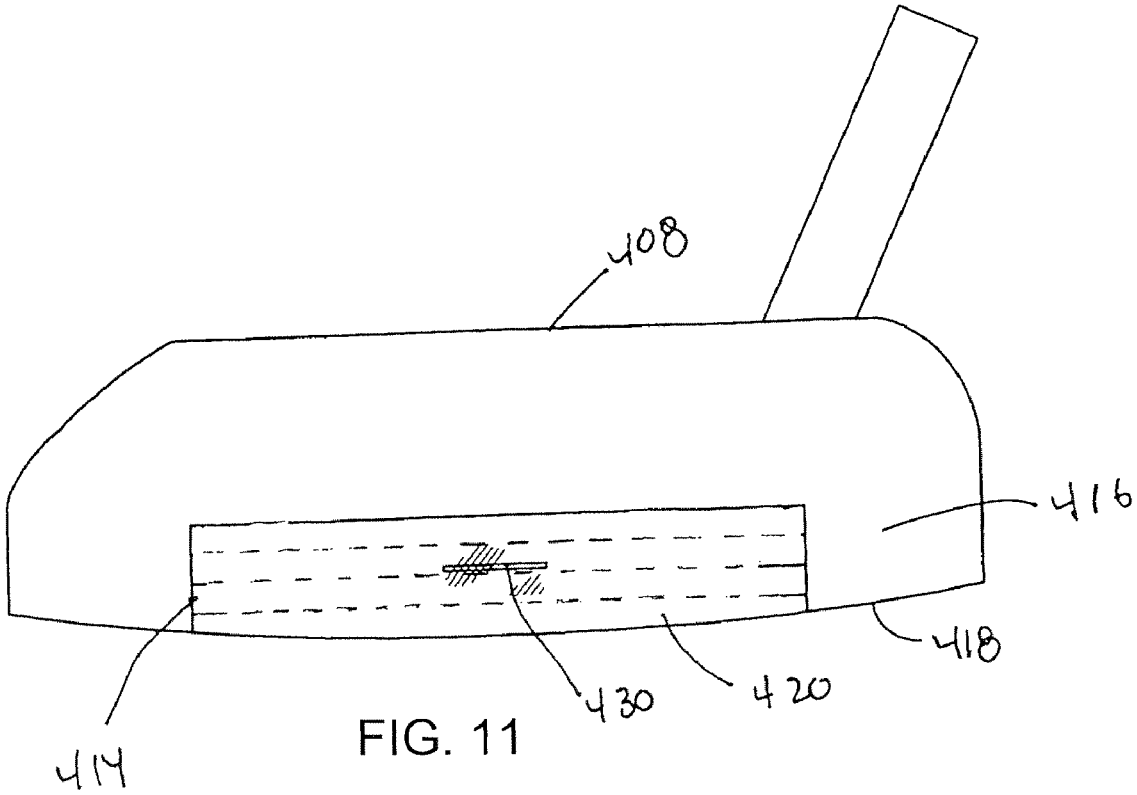
FIG. 11 is a front view of FIG. 10.
Figure 12:
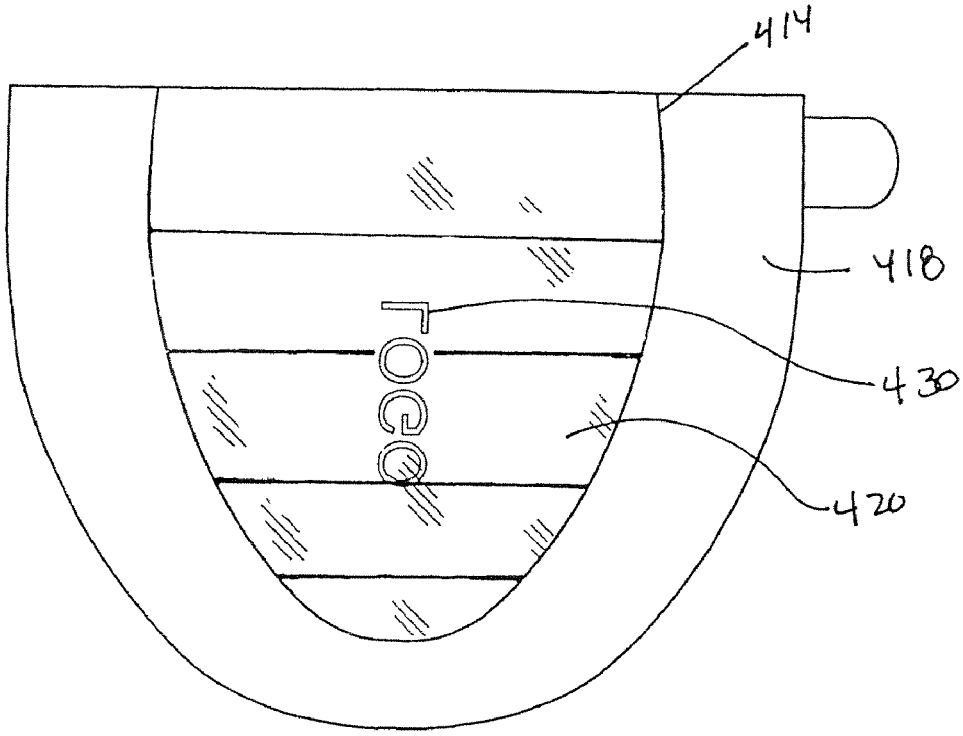
FIG. 12 is a bottom view of FIG. 10.

Referring now to FIG. 10 through 12, the golf club head 400 includes a body 402 shaped similarly to the previous first embodiment. The body 402 has a heel 404, a toe 406, a front portion 408, and a back portion 410. The top portion 412 of the body 402 is solid with a bore 414 defined in the face 416 and lower portion 418 of the body 402. The bore 414 is fitted with an insert 420 that is transparent or semi transparent. Within the insert 420 is indicia 430. This permits the indicia 430 to be viewed only from bottom of the club head or when the club head is turned over and resting in a golf bag. Therefore the user is not distracted from the indicia when the club is in use.

Figure 13:
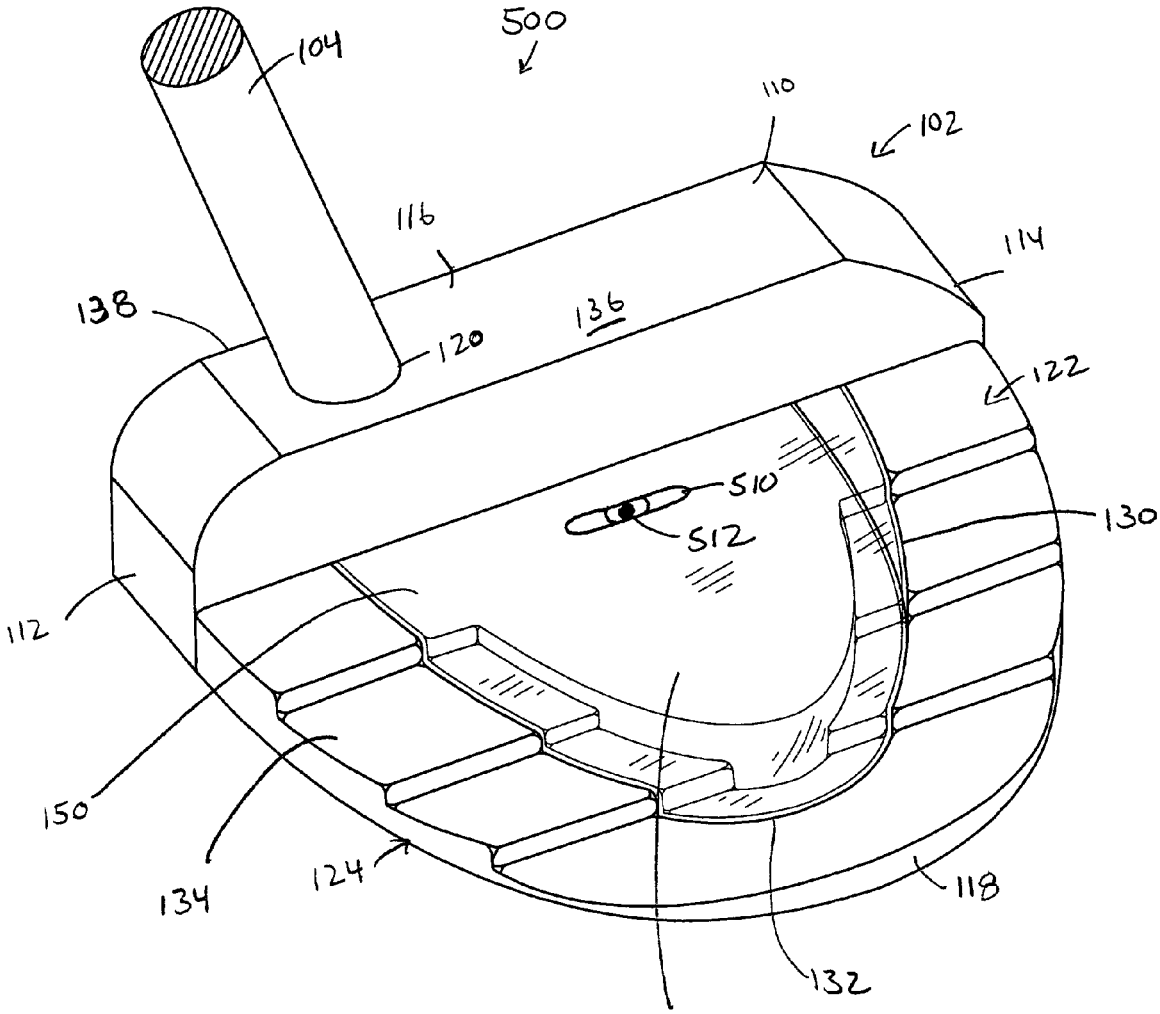
FIG. 13 is a perspective view of a fifth alternative club head in accordance with the present invention.

Referring now to FIG. 13, a fifth golf club head 500 is illustrated. The fifth golf club head 500 is similar to the first embodiment 100, and similar parts have similar reference numbers. Unlike the previous embodiment with indicia, the insert 150 includes a leveling indicator 510 positioned substantially parallel to the bottom surface. The leveling indicator 510 provides the user with a spirit level or "bubble" 512 for orientation leveling device to indicate when the leveling indicator 510 is substantially horizontal. It is to be understood that the spirit level constitutes a glass vial within which is located a liquid and contained within that liquid is an air bubble. The construction of such spirit level is deemed to be conventional. The leveling indicator 510 acts as a training device to allow the user to gain a better understanding of the levelness of the club head relative to the surface being putting on. When the club head is level, the putter will strike the ball flush and allow for a more accurate roll as opposed to striking the ball at an include or decline an thus negatively impacting the roll of the ball. A flush impact would also maximize the effect of the insert material used in the putter face to better control the roll of the ball.

Figure 14:
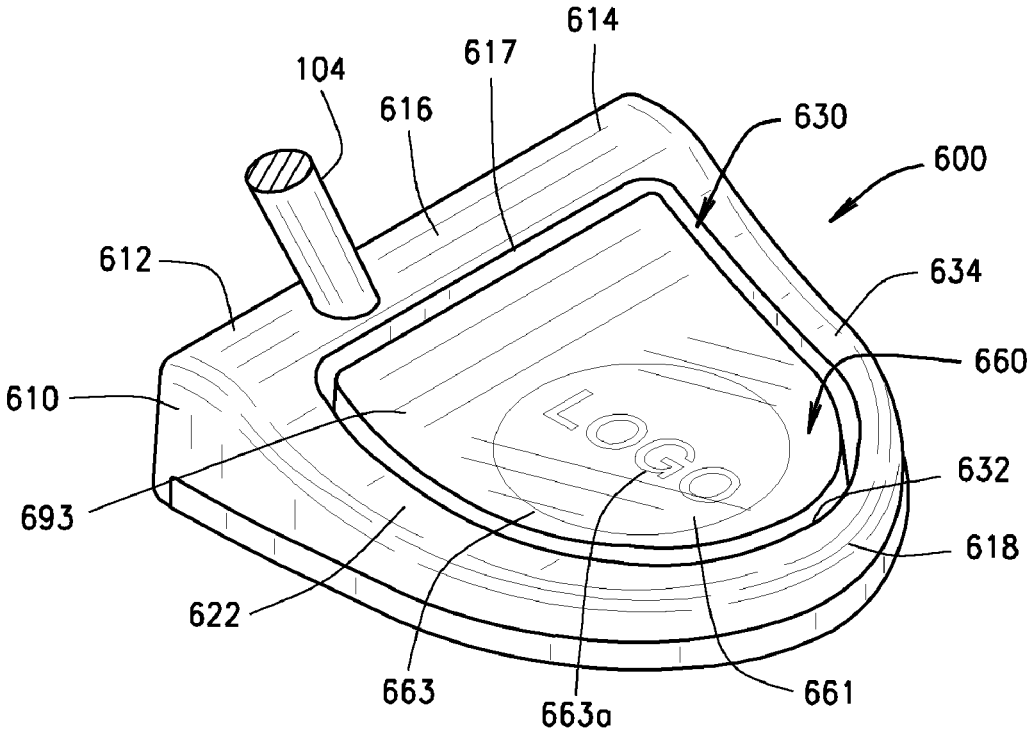
FIG. 14 is a top perspective view of a sixth alternative golf club head in accordance with the present invention.
Figure 15:
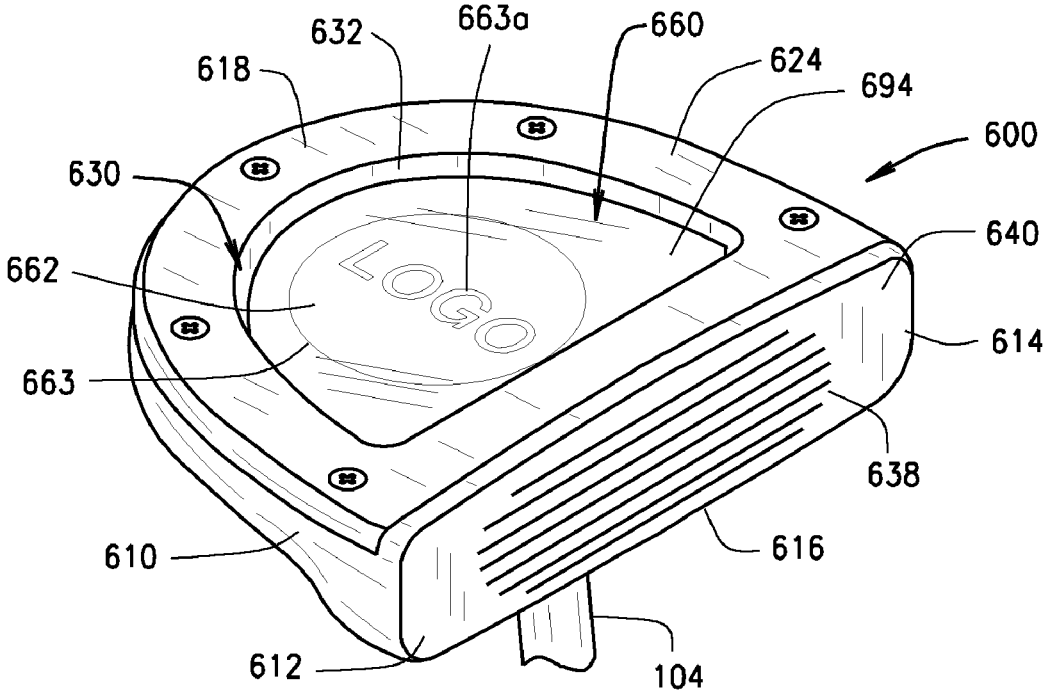
FIG. 15 is a bottom perspective view of the golf club head of FIG. 14.

Referring to FIGS. 14-21, a sixth golf club head 600 is illustrated. The golf club head 600 is shown as a putter, however, the golf club head 600, may take any form of club. As shown in FIGS. 14 and 15, the golf club head 600 comprises a body 610 having a heel 612, a toe 614, a front portion 616, and a back portion 618. The shaft 104 secures to the front portion 616 of the golf club head 600. The body 610 also includes an upper surface 622 and a bottom surface 624. The body 610 is constructed using the materials described herein.

The body 610 also includes an aperture or opening 630 formed in the body 610 of the golf club 600. The aperture 630 passes from the upper surface 622 through a central portion of the body 610 and through to the bottom surface 624. The aperture 630 starts at a rear surface 617 of the front portion 616 and extends across the body 610 to an inside portion 632 formed on an interior side of the back portion 618. A backside arc portion 634 extends from the heel 612 to the toe 614 and from the front portion 616 to the back portion 618.

An insert 660 is positioned in the aperture 630 forming a window through the golf club head 600. The insert 660 comprises an indicia 663 embedded in or formed interior to the insert 660. The insert is formed of a transparent or semi-transparent material such that the indicia 663 is visible when viewing the insert 660. The aperture 630 and the insert 660 provide for the user of the golf club head 600 to view through the golf club head 600 to the ground, upon which a golf ball may be resting. In this embodiment, the insert 660 is viewable from the top (as in FIG. 17) and the bottom (as in FIG. 18) of the golf club head 600. The insert 660 fills or substantially fills the aperture 630.

With reference to FIGS. 20(A)-(D), and as with the other embodiments, the insert 660 may comprises the indicia 663 with a logo indicia 663*a* comprising an image of a logo, word, letter, number, design, trademark, brand, corporate name, writings, phrases, etc. or combination thereof. Other indicia 663 include an indicia 663*b*, which includes an image of a straight line. Preferably, the straight line is oriented generally perpendicular to the striking face 638. The straight line may be used by the golf player to assist in aligning the golf shot. The straight line on the indicia 663*b* may be used in conjunction with a second straight line drawn or printed on a golf ball. By aligning the straight line on the indicia 663*b* with the straight line on the golf ball in a collinear fashion, the directional alignment during the swinging of the golf club of the golf shot may be aided. Other indicia include a two-dimensional golf ball image shown as 663*c* or a three dimensional golf ball image shown as 663*d*. The inclusion of the two-dimensional golf ball image 663*c* or the three dimensional golf ball image 663*d* inside the insert 660 may serve as an aid as the golfer aligns and makes their golf shot.

Figure 17:
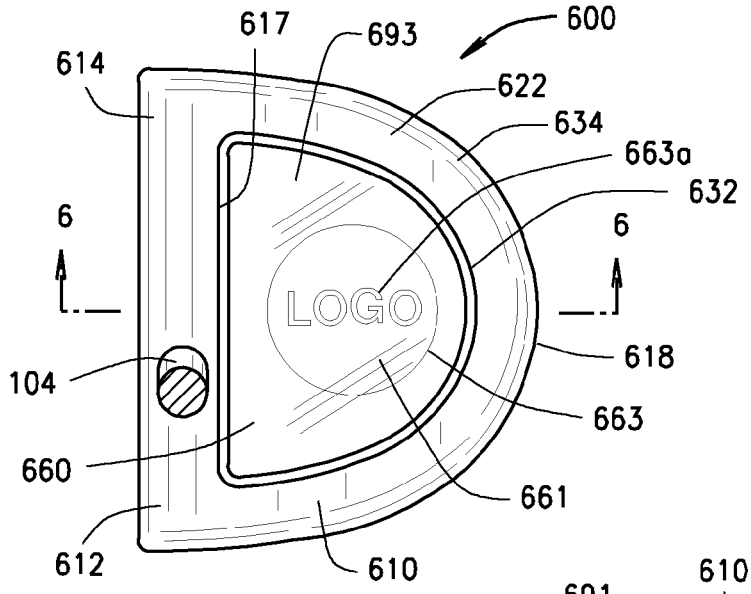
FIG. 17 is a top view of the golf club head of FIG. 14.
Figure 18:
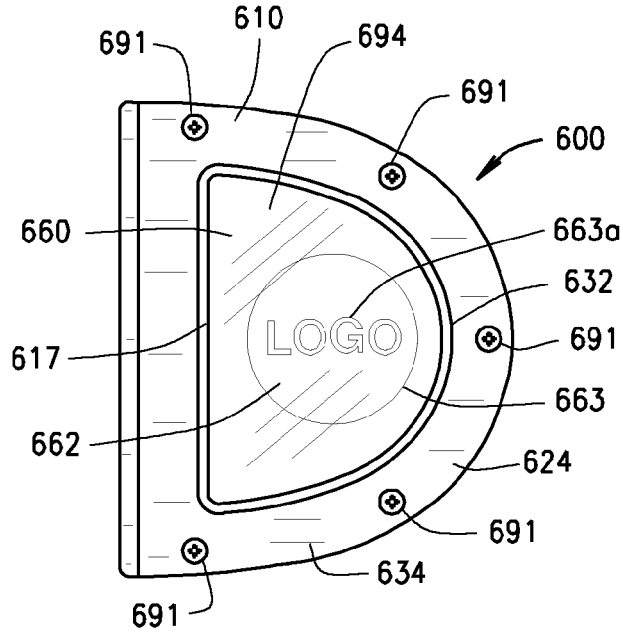
FIG. 18 is a bottom view of the golf club head of FIG. 14.
Figure 19:
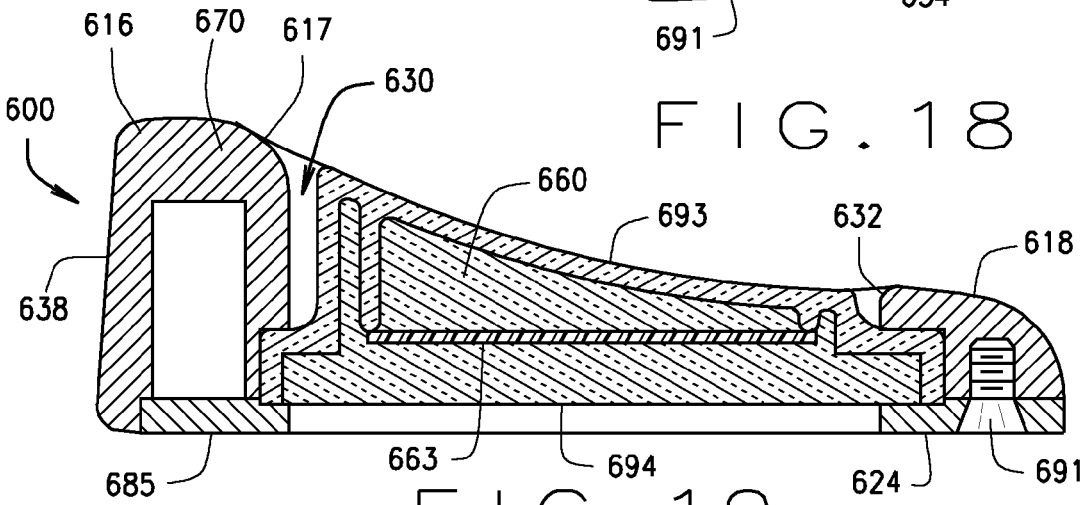
FIG. 19 is a cross-sectional view of the golf club head of FIG. 14.
Figure 20A:
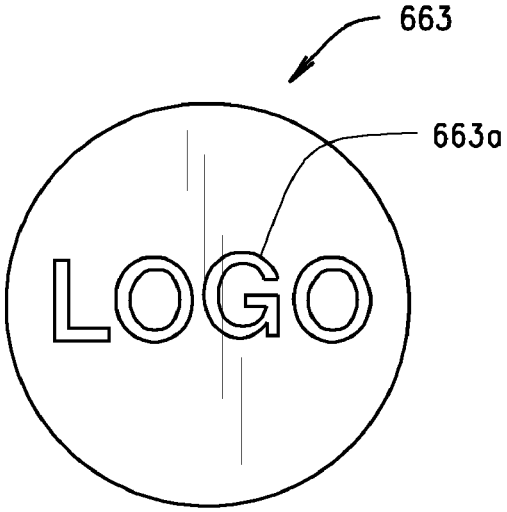
FIGS. 20(A)-(D) are views of the indicia.
Figure 20B:
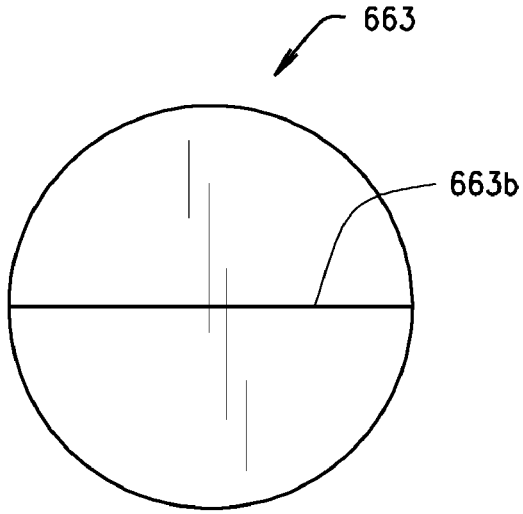
Figure 20C:
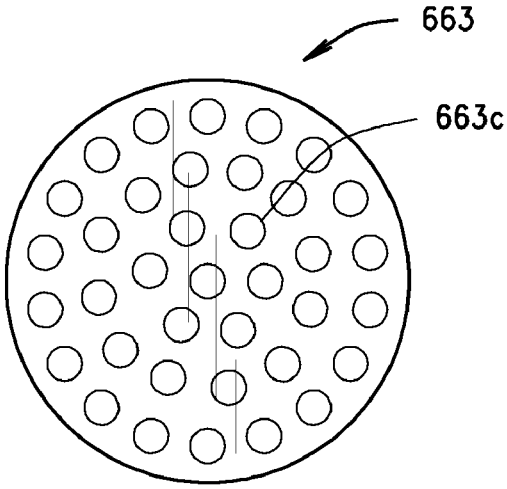
Figure 20D:
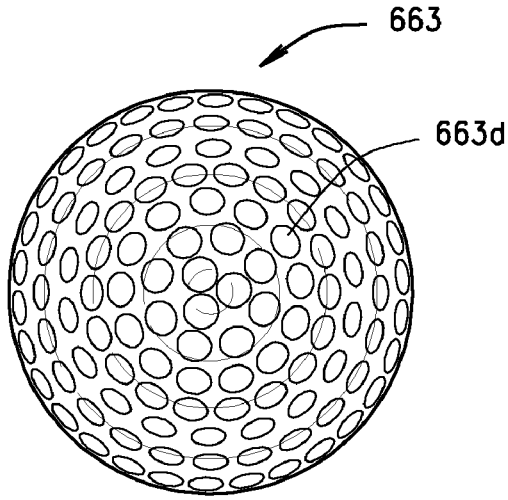

Any of a combination of the same or different indicia 663*a*-663*d* may be used with the insert 660. As shown in FIGS. 17 and 18, any of a combination of the same or different indicia 663*a*-663*d* may be used on a bottom surface 662 of the indicia 663 and on an upper surface 661 of the indicia 663. As such, the golf club head 600 may be customized for a particular golf tournament, corporate sponsorship, advertisement, promotion, etc. Further, the golf club head 600 may be customized to include the images that aid the golfer during the set-up and performance of the golf-shot. Although the indicia 663 is shown as having a generally circular shape, the indicia 663 may be square, rectangular, ovular, free-form, or any other shape.

In general, the indicia 663*a* with the logo is primarily used on the bottom surface 662 of the indicia 663, such that the logo is visible through the bottom of the club head 600 when the club is placed in the golf bag in an upside down position with the club head 600 sticking out of or partially sticking out of the golf bag. This provides a branding and marketing opportunity for the logo of the indicia 663*a*. The straight line indicia 663*b*, and the golf ball images 663*c* or 663*d*, are generally used on the upper surface 661 of the indicia 663, providing for these indicia to assist the golfer in alignment of the shot. Of course, the indicia 663*a* with the logo may be used on both the bottom surface 662 and the upper surface 661 of the indicia 663, or the indicia 663*b-d* may be used on both the bottom surface 662 and the upper surface 661 of the indicia 663.

As with other embodiments, the indicia 663 may comprise a board, film, paper, or other sheet like material or substrate that will support the indicia 663*a-d*. The indicia 663 may be transparent, semi transparent, opaque, or solid. The indicia 663*a-d* may be mounted onto a Mylar film or other transparent material and transferred to the indicia 663, or the indicia 663*a-d* may be printed directly to the indicia 663.

Figure 16:
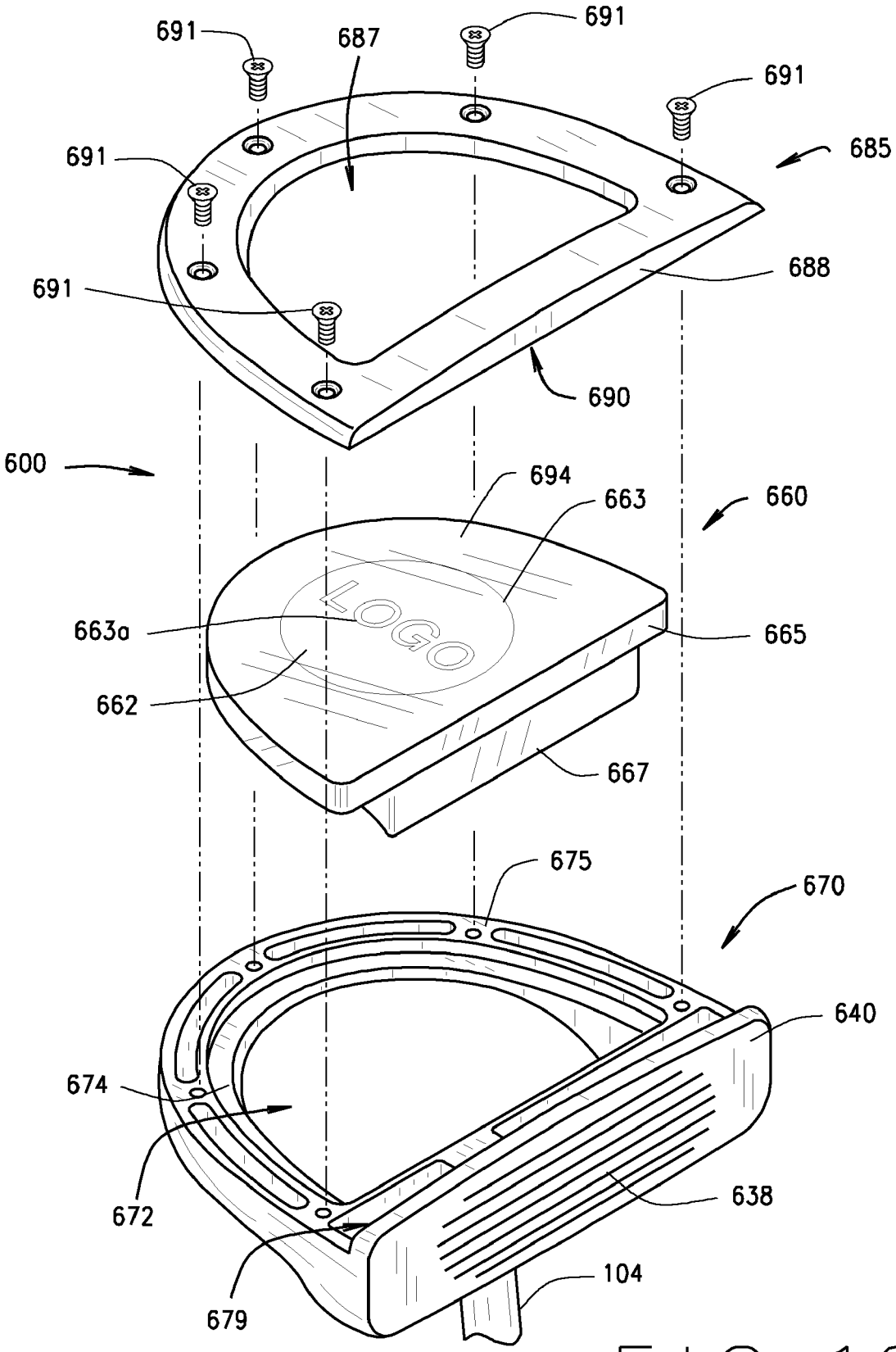
FIG. 16 is an exploded view of the golf club head of FIG. 14.

With reference to FIG. 16, an exploded view of the golf club head 600 is shown. The golf club head 600 comprises a lower body 685 defining a lower body aperture 687 and an upper body 670 defining an upper body aperture 672. The lower body 685 and the upper body 670 are joined to form the body 610. The combination of the lower body aperture 687 and the upper body aperture 672 form the aperture 630. A lower body engaging surface 690 of the lower body 685 engages an upper body engaging surface 675 of the upper body 670. A lower body front edge 688 abuts a rear surface 679 of the front face 640. In this embodiment, screws 691 are shown in order to attach the lower body 685 to the upper body 670. Other fastening devices and techniques, such as fasteners, pins, rivets, bolts, adhesives, epoxies, mechanical joints, solders, welds, etc. may be employed in order to join, attach, or connect the lower body 685 to the upper body 670.

The insert 660 comprises a flange portion 665 that forms a bottom surface 694 of the insert 660. The insert 660 also comprise an aperture portion 667, which is smaller in diameter or size than the flange portion 665 and is integral to the flange portion 665. During construction of the golf club head 600, the aperture portion 667 is inserted into the upper body aperture 672 and the flange portion 665 rests against a shelf portion 674 in the upper body aperture 672. The attachment of the lower body 685 to the upper body 670 secures the insert 660 in a fixed position in the golf club head 600.

The golf club head 600 provides the aperture 630 comprising the insert 660 having the indicia 663 visible from the top and bottom of golf club head 600. The insert 600 is generally fully encircled by the body 610. The upper surface 622 and the back side arc portion 634 surround a top surface 693 of the insert 660. The bottom surface 624 and the back side arc portion 634 surround a bottom surface 694 of the insert 660. The body 610 includes the front face 640 with the striking face 638 integrally formed from the upper body 670 of the body 610.

Figure 21A:
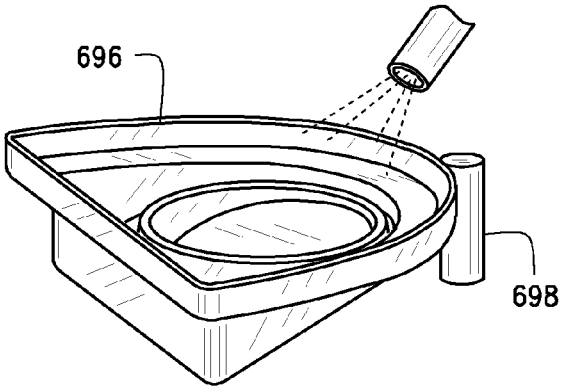
FIGS. 21(A)-(F) shows a manufacturing process for the golf club head.
Figure 21B:
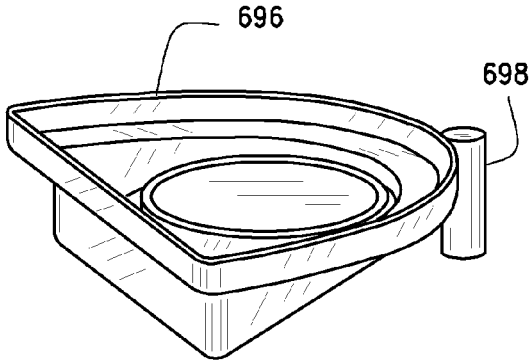
Figure 21C:
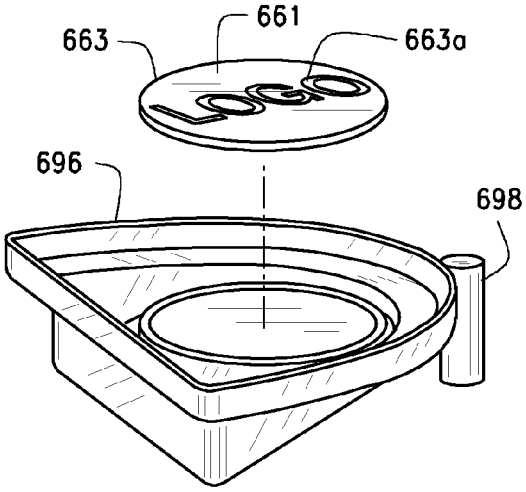
Figure 21D:
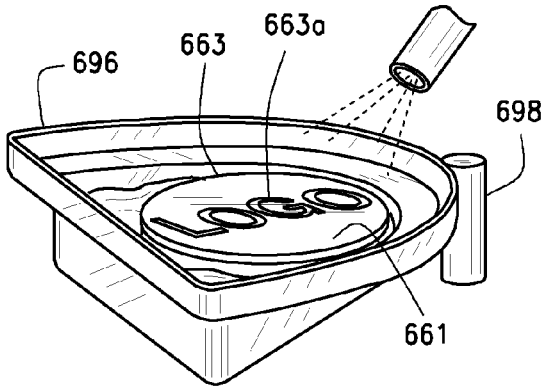
Figure 21E:
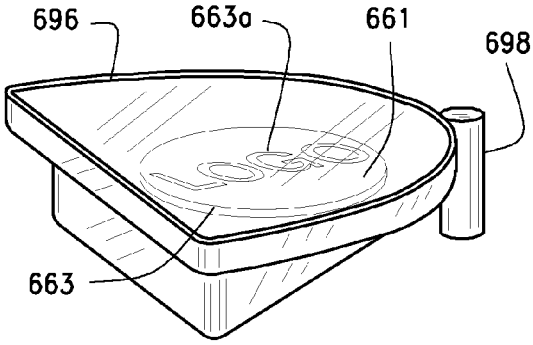
Figure 21F:
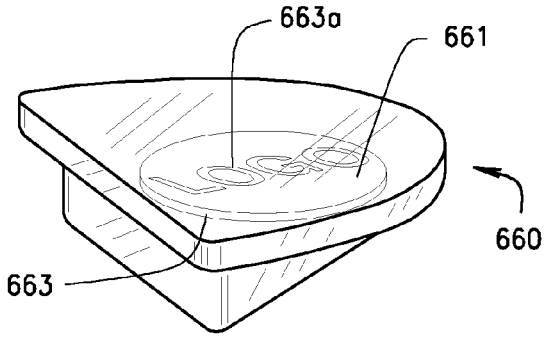

With reference to FIGS. 21(A)-21(F), a method of manufacturing the insert 660 is shown. As shown in FIGS. 21(A) and 21(B), a mold 696 is partially filed with a first amount of a liquid plastic material, such as acrylic, polycarbonate, or other suitable materials as described herein. After the first amount of the liquid plastic material has set or solidified enough, the indicia 663 is placed on the plastic material in the mold 696 as in shown in FIG. 21(C). Then, a second amount of the liquid plastic material is added on top of the first amount of liquid plastic material and the indicia 663 (as shown in FIG. 21(D)) in order to complete the insert 660. After the second amount of liquid plastic material has set or becomes firm, then the insert 660 is removed from the mold 696 and the insert 660 is trimmed and smoothed of any excess plastic material, such as a leveling post 698. With reference to FIG. 21(F), the insert 660 has been trimmed and is now ready for use.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

What is claimed is:

1. A golf club head having upper and lower surfaces, comprising: a body defined as having a heel, a toe, a front portion with a defined striking face, and a back portion; an aperture in the body extending from the upper surface to the lower surface and extending from the front portion to an inside portion of the back portion; an insert secured within the aperture; the insert comprises a flange portion that forms a bottom surface of the insert, and the insert comprise an aperture portion, which is smaller in diameter or size than the flange portion, wherein the aperture portion is integral to the flange portion; an indicia within the insert that is visible from the upper and lower surfaces of the golf club head; and the front portion of the body forms the defined striking face.

2. The golf club head of claim 1, wherein a backside arc portion extends from the heel to the toe and from the front portion to the back portion.

3. The golf club head of claim 1, wherein the body encircles the insert.

4. The golf club head of claim 1, wherein the body comprises a lower body defining a lower body aperture and an upper body defining an upper body aperture.

5. The golf club head of claim 4, wherein the upper body forms the defined striking face.

6. The golf club head of claim 4, wherein the upper body and the lower body are joined together and secure the insert.

7. The club head of claim 1, wherein the insert is of a transparent or semi transparent material.

8. The golf club head of claim 1, wherein the insert substantially fills the aperture.

9. The golf club head of claim 1, wherein the body is of a material selected from one or more of the following, bismuth metal, bismuth oxide, or bismuth trioxide.

10. The golf club head of claim 1, wherein the indicia comprises an image of a logo, word, letter, number, design, trademark, brand, corporate name, writings, phrases, or combinations thereof.

11. The golf club head of claim 1, wherein the indicia comprises a two dimensional image of a golf ball, a three dimensional image of a golf ball, a straight line, or combination thereof.

12. The golf club head of claim 1, wherein the indicia comprises an image on both an upper surface of the indicia and on a bottom surface of the indicia.

13. The golf club head of claim 12, wherein the image is the same on both on the upper surface and on the bottom surface of the indicia.

14. The golf club head of claim 12, wherein a first image is on the upper surface and a second image is on the bottom surface of the indicia, and the second image is different from the first image.

15. The golf club head of claim 1, wherein the indicia is embedded in the insert.

16. The golf club head of claim 1, wherein the body comprises a lower body defining a lower body aperture and an upper body defining an upper body aperture; wherein the aperture portion of the insert is inserted into the upper body aperture and the flange portion rests against a shelf portion in the upper body aperture, and a joining of the lower body to the upper body secures the insert in a fixed position in the golf club head.

17. A golf club head, comprising: a body defined as having a heel, a toe, a front portion with a defined striking face, a back portion, an upper surface, and a lower surface; an opening in the body extending though the body from the upper surface to the lower surface of body; an insert made from a transparent or semi-transparent plastic material secured within the opening, the insert comprises a flange portion that forms a bottom surface of the insert, and the insert comprise an aperture portion, which is smaller in diameter or size than the flange portion, wherein the aperture portion is integral to the flange portion; wherein the insert substantially fills the opening, and an indicia is embedded in the insert that is visible from the upper and lower surfaces of the body.

18. A golf club head, comprising:

an upper body comprising a striking face, a heel portion and a toe portion;

the upper body defining an upper body aperture;

a lower body forming a part of a bottom surface of the golf club head;

the lower body defining a lower body aperture;

a transparent or semi-transparent insert comprising an indicia;

the insert comprises a flange portion that forms a bottom surface of the insert, and the insert comprise an aperture portion, which is smaller in diameter or size than the flange portion, wherein the aperture portion is integral to the flange portion; and the lower body joinable to the upper body to secure the insert within the lower body aperture and the upper body aperture.

* * * * *